US006318121B1

(12) United States Patent
Pachauer

(10) Patent No.: US 6,318,121 B1
(45) Date of Patent: Nov. 20, 2001

(54) JEWELRY APPARATUS

(75) Inventor: Werner Pachauer, Oak Forest, IL (US)

(73) Assignee: Fantasy Diamond Corp., Chicago, IL (US)

( * ) Notice: Subject to any disclaimer, the term of this patent is extended or adjusted under 35 U.S.C. 154(b) by 0 days.

(21) Appl. No.: 09/374,190

(22) Filed: Aug. 13, 1999

(51) Int. Cl.[7] ..... A44C 17/02
(52) U.S. Cl. ..... 63/26; 63/28
(58) Field of Search ..... 63/26, 28

(56) References Cited

U.S. PATENT DOCUMENTS 630,197 * 8/1899 Dover et al. ..... 63/28
954,568 * 4/1910 Gebhardt ..... 63/28
1,252,966 * 1/1918 Suderov ..... 63/28
1,440,229 * 12/1922 Mestekin ..... 63/28
5,099,660 * 3/1992 Dostourian ..... 63/27 X
5,377,506 * 1/1995 Tranzer ..... 63/28

FOREIGN PATENT DOCUMENTS

1120076 * 6/1956 (FR) ..... 63/28

* cited by examiner

*Primary Examiner*—B. Dayoan
*Assistant Examiner*—Andrea Chop
(74) *Attorney, Agent, or Firm*—Larry L. Saret; Lisa C. Childs; Michael Best & Friedrich LLC

(57) ABSTRACT

Jewelry and a method of setting gemstones in the jewelry include an anchor gemstone and a touch gemstone that is held in place with no metal from the setting visible between the gemstones. The anchor gemstone is held in place using a conventional setting arrangement such as channel walls or prongs. The gemstones are positioned in the setting with the upper pavilion of the anchor gemstone overlapping and contacting the crown of the touch gemstone so that the contact between the gemstones holds the touch gemstone in place.

7 Claims, 2 Drawing Sheets

JEWELRY APPARATUS

FIELD OF THE INVENTION

The present invention relates to jewelry and a method for setting gemstones in a piece of jewelry. More particularly, the present invention relates to so-called invisible setting methods for setting gemstones in a piece of jewelry such that at least one gemstone is held in place by an adjacent gemstone with no metal visible between the gemstones or at least one gemstone is set without metal visible above the girdle of the gemstone.

BACKGROUND INFORMATION

Gemstones can be set in a piece of jewelry in a number of ways. For example, prior art jewelry setting methods include prong setting, channel setting and invisible setting.

The most common method of setting a gemstone is prong setting. A prong setting comprises at least two thin metal supports that extend from a common base to wrap around and grip opposing upper edges of the girdle of a gemstone. The base of the prong setting is typically attached to a piece of jewelry, such as a ring, to secure the gemstone to the piece of jewelry. While prong setting is an easy and economical method of securing a gemstone to a piece of jewelry, the metal supports are clearly visible and detract from the beauty of the gemstone. Since the supports are exposed, they are also subject to breakage and loss of the gemstones.

Channel setting is another method of setting gemstones in a piece of jewelry. A channel setting comprises a U-shaped channel for holding a row of gemstones in place in the piece of jewelry. The gemstones are placed in the channel and grooves in the opposing walls of the channel engage the girdle of the gemstones. The gemstones are held in the channel by the two opposing walls and grooves in the walls. Channel settings share the same problems as prong settings, namely, that the opposing walls of the setting are visible and detract from the beauty of the gemstones.

Another type of gemstone setting method is the so-called invisible setting method. As the name suggests, the gemstone-securing structure of an invisible setting method is not visible when the gemstone is installed.

The conventional invisible setting method requires a groove to be cut in the lower surfaces or pavilion of the gemstone. Two parallel rails are included in the setting and are configured to engage the grooves in the gemstone to secure the gemstone onto the jewelry piece. Using this method, rails are concealed from view by the girdle and crown of the gemstones. Also, multiple gemstones can be set with their adjacent edges juxtaposed so that the rails are not visible between the gemstones.

While this conventional invisible setting method produces stunning visual effects because the setting is not visible between the gemstones and the gemstones appear to look like one gemstone, the method is difficult and expensive to implement and its use is very limited. For example, this method only works well with specific gemstone shapes such as square or princess cut gemstones. Also, because it requires grooves to be cut into the gemstone, the luster, quality and value of the gemstone is adversely affected.

Thus, there is a need for a invisible method of setting gemstones which is inexpensive and versatile. There is also a need for an invisible setting method that does not adversely affect the luster, quality or value of the gemstone or require the gemstone to be damaged.

SUMMARY OF THE INVENTION

These needs and others are satisfied by the jewelry apparatus and method of setting gemstones therein of the present invention. A jewelry apparatus according to the present invention comprises an anchor gemstone, a touch gemstone, and setting means for setting the anchor and touch gemstones in the jewelry apparatus. According to the present invention, the anchor gemstone is set adjacent to the touch gemstone. The touch gemstone is positioned slightly below the anchor gemstone and is held in place by the anchor gemstone, thereby keeping it in place and concealing the setting means. In this manner, the touch gemstone is set in the jewelry apparatus using an invisible setting method without having to cut a groove in the touch gemstone or use side rails to hold it in place.

Preferably, the jewelry apparatus includes at least two anchor gemstones. The anchor gemstones are held in the jewelry apparatus by any conventional setting means and the touch gemstone is held in the jewelry apparatus by the anchor gemstones.

Each of the anchor gemstones and the touch gemstone comprise a crown and a pavilion. Preferably, the crown of the touch gemstone contacts the pavilions of the anchor gemstones, just below their respective girdles, holding the touch gemstone in place in the jewelry apparatus.

In one embodiment, the setting means include a base having three cavities, each substantially the same size as the pavilion of a corresponding one of the anchor gemstones or the touch gemstone. The pavilions of the anchor gemstones and touch gemstone rest in the cavities with the girdle and crown of the gemstones sitting above the base. The setting means also includes channel walls configured to contact the anchor gemstones for holding the anchor gemstones in place in the jewelry apparatus. However, the channel walls do not run between the anchor gemstones and the touch gemstone.

The channel walls may further comprise a wedge between the anchor gemstones for tightening the anchor gemstones in place in the jewelry apparatus. The wedge width is tapered so that is it thinner near the bottom end than the top end. The anchor gemstones are tightened in place by driving the wedge down so that the thicker top end fills any space between the anchor gemstones.

The gemstones can be set in the jewelry apparatus in rows in a so-called channel setting, with a row of touch gemstones held in place between two rows of anchor gemstones. The channel setting means, however, is not visible between the anchor gemstones and the touch gemstones.

A method for setting a plurality of gemstones in a jewelry apparatus according to the present invention includes the steps of placing a touch gemstone in a cavity in a setting means and placing anchor gemstones in cavities in the setting means adjacent to the touch gemstone and a channel wall of the setting means. The anchor gemstones pavilions contact the touch gemstone crown, holding the touch gemstone in place without the setting means being visible between the anchor gemstones and the touch gemstone, and with the anchor gemstone overlapping the girdle of the touch gemstone.

The method can also include the step of tightening the setting means around the anchor gemstones by driving a wedge on the channel wall between the anchor gemstones and toward the base.

The method can be used for setting a plurality of rows of gemstones in a so-called channel setting by first placing a row of touch gemstones in a row of cavities in the setting means base and then placing rows of anchor gemstones in rows of cavities in the setting means base adjacent to the row of touch gemstones. Overlapping and contact between the row of touch gemstones with the rows of anchor gemstones holds the row of touch gemstones in place without the setting means being visible between the rows of anchor gemstones and the row of touch gemstones.

DETAILED DESCRIPTION OF THE PREFERRED EMBODIMENT

In accordance with the present invention, a jewelry apparatus and method of setting gemstones therein is described that provides distinct advantages when compared to those of the prior art. The invention can best be understood with reference to the accompanying drawing figures.

Figure 1:
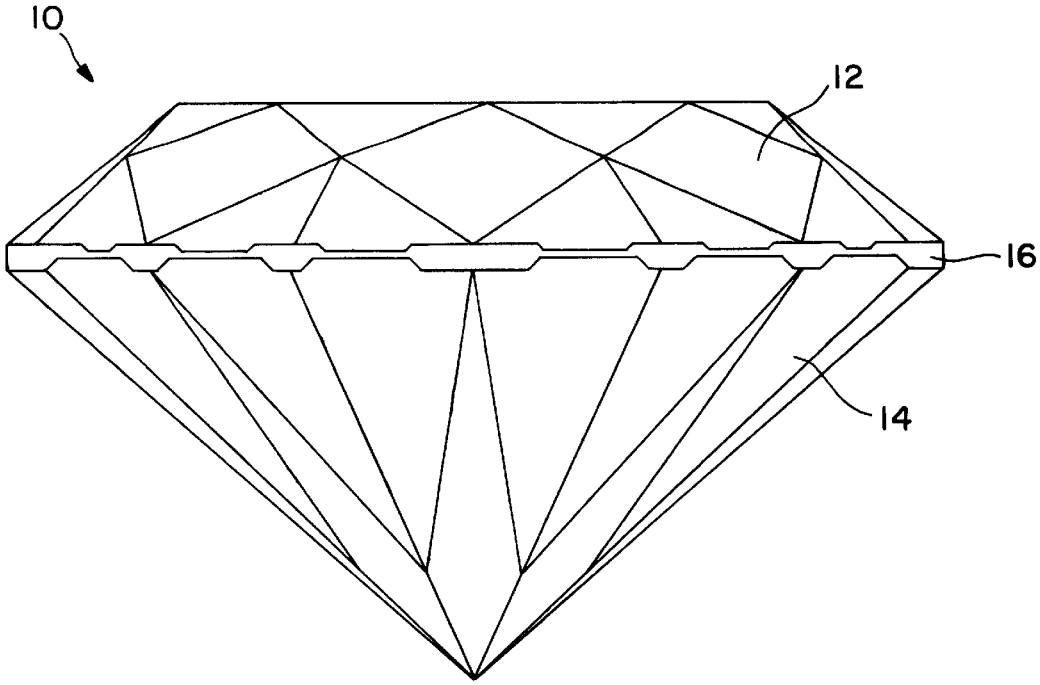
FIG. 1 is side view of the shape of a conventional gemstone.

FIG.1 shows the shape of a conventional gemstone 10. The gemstone 10 includes a crown 12, a pavilion 14 and a girdle 16.

Figure 2:
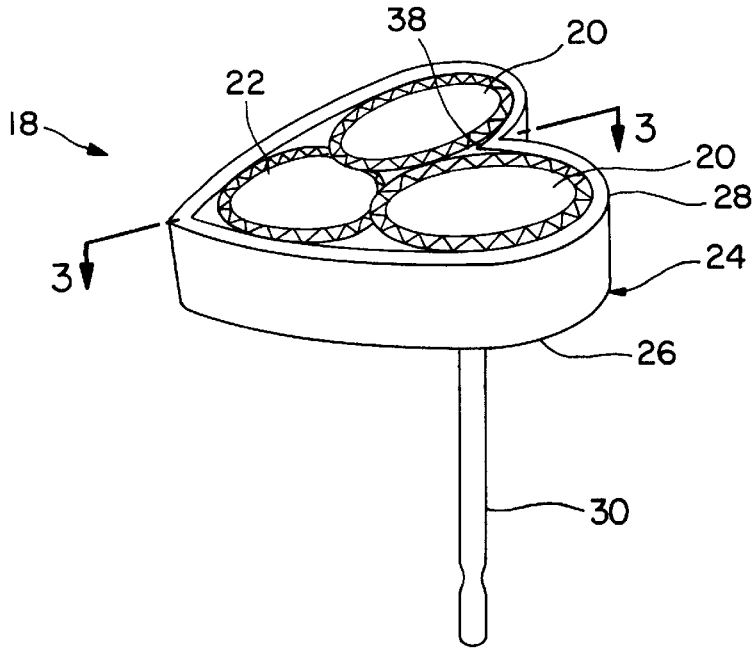
FIG. 2 is perspective view of a jewelry apparatus according to the present invention.
Figure 3:
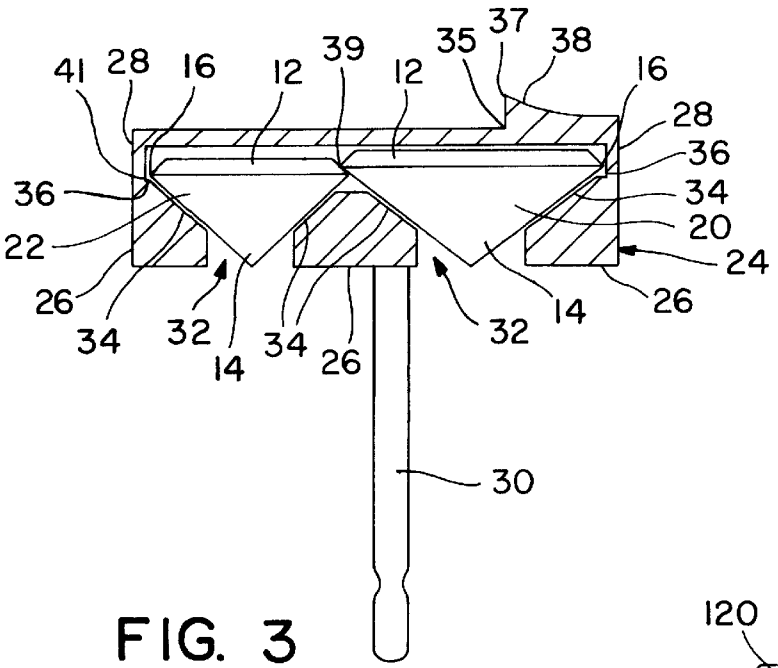
FIG. 3 is cross-sectional view of the jewelry apparatus of FIG. 2 taken alone 3—3.

Referring now to FIGS. 2 and 3 a jewelry apparatus according to the present invention, generally designated by reference numeral 18, is shown. The jewelry apparatus 18 of FIGS. 2 and 3 is an earring for use in a pierced ear. The jewelry apparatus 18 comprises two anchor gemstones 20, a touch gemstone 22 and setting means 24.

The setting means 24 includes a base 26, channel walls 28 and a connecting post 30. The connecting post 30 is configured for insertion through a hole pierced in the user's earlobe. An earring nut (not shown) is inserted onto the connecting post 30 on the back side of the earlobe for holding the earring in place on the pierced ear. The setting means 24 is typically made of a precious metal material such as gold or platinum.

The base 26 includes several cavities 32, each configured for accepting the pavilion 14 of the anchor gemstones 20 and the touch gemstone 22. The cavities 32 are sized so that the gemstone pavilions 14 can be held in the cavities 32 with the gemstone crowns 12 and girdles 16 sitting above the base 26. The cavities 32 can also include angled countersunk side walls 34, generally corresponding to the angle of the gemstone pavilion 14, for further accommodating an angled gemstone pavilion 14.

The channel walls 28 are configured for holding the anchor gemstones 20 in place in the jewelry apparatus 18. The channel walls 28 include grooves 36 located above the base 26 that mate with girdle 16 of the anchor gemstones 20, as well as the girdle 16 of the touch gemstone 22. The channel walls 28 contact the anchor gemstones 20 in at least two places (between the anchor gemstones 20 and on opposing ends of the anchor gemstones 20) but do not run between the anchor gemstones 20 and the touch gemstone 22.

The channel walls 28 may also include a wedge 38 positioned between the anchor gemstones 20 for securing the anchor gemstones 20 in place in the jewelry apparatus 18. The width of wedge 38 is thinner near the bottom end 35 than the top end 37. Thus, as the wedge 38 is driven downward, toward the base 26, space between the anchor gemstones 20 is taken up by the width of wedge 38 locking the anchor gemstones 20 in place in the setting means 24.

As illustrated in FIG. 3, the touch gemstone 22 is configured to be set slightly below the anchor gemstones 20. As described above, one side 41 of the girdle 16 of the touch gemstone 22 is held in place by the groove 36 in the channel wall 28 of the setting means 24. An opposite end 39 of the touch gemstone 22 is held in place by the anchor gemstones 20.

The cavities 32 in the base 26 of the setting means 24 are sized to hold the touch gemstone 22 slightly lower than the anchor gemstones 20. The cavities 32 are positioned such that the girdles of anchor gemstones 20 overlap the girdle of touch gemstone 22. As is illustrated in the drawings, the upper pavilions 14, just under the girdles 16, of the anchor gemstones 20 contact the outer edge 39 of the crown 12 of the touch gemstone 22 to lock the touch gemstone 22 in place in the setting means 24.

Because the anchor gemstones 20 overlap the touch gemstone 22, the touch gemstone 22 is held in place and no metal from the setting means 24 is visible between the anchor gemstones 20 and the touch gemstone 22. This method of setting gemstones produces the stunning visual effects of invisible setting methods without requiring grooves to be cut in the gemstones. This method is also very versatile in that many shapes of gemstones can be set using this method.

A method for setting gemstones according the present invention comprises forming a base including cavities in a setting means of a piece of jewelry, placing the touch gemstone 22 in the appropriate cavity 32 in the base 26 of the setting means 24, and placing the anchor gemstones 20 in the appropriate cavities 32 in the base 26. The gemstones 20 and 22 are positioned such that the anchor gemstones 20 overlap the touch gemstone 22 with the pavilion 14 of the anchor gemstones 20 contacting the crown 12 of the touch gemstone 22. The girdles 16 of the anchor gemstones 20 are located above the girdle 16 of the touch gemstone 22 and preferably in grooves 36 formed in the channel walls 28. In this manner the gemstones are locked in place and the setting means 24 is not visible between the touch gemstone 22 and the anchor gemstones 20.

The method can also include driving the wedge 38 in the channel wall 28 between the anchor stones 20 downward toward the base 26 to further lock, tighten and secure the anchor gemstones 20 in place.

While a specific method of setting the anchor gemstones 20 has been described above, it can be appreciated that any conventional method of setting the anchor gemstones 20 can be used without departing from the invention disclosed and claimed herein. It can also be appreciated that while the setting means 24 shown in FIGS. 2 and 3 is heart-shaped, other shapes and forms of setting means 24 can be used. For example, a four leaf clover-shaped setting means can be used with four anchor gemstones, one in each leaf of the four leaf clover, holding one touch stone in the center of the shape. Various other shapes and forms are contemplated.

Figure 4:
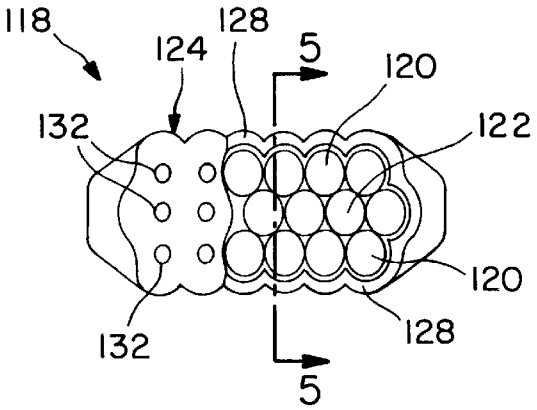
FIG. 4 is a top plan view of an alternative embodiment of a jewelry apparatus according to the present invention.
Figure 5:
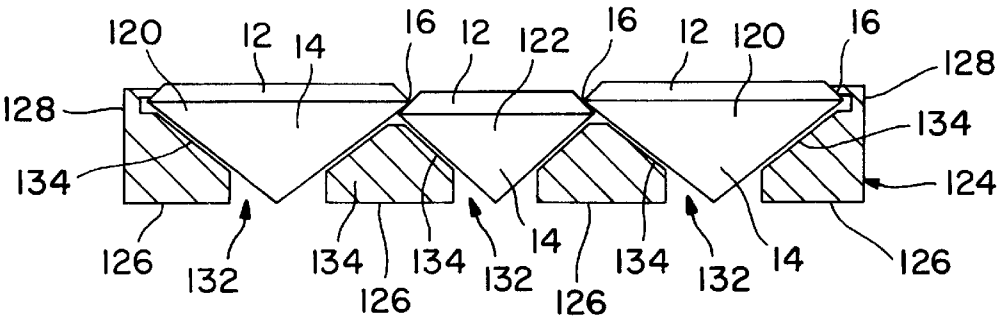
FIG. 5 is a cross-sectional view of the jewelry apparatus of FIG. 4 taken along line 5—5.

FIGS. 4 and 5 illustrate an alternative embodiment of the present invention in which three rows of gemstones are set in a ring using a so-called channel setting method in combination with the inventive setting method. In this embodiment, the jewelry apparatus 118 comprises two rows of anchor gemstones 120, a row of touch gemstones 122 and a setting means 124.

The setting means 124 includes a base 126 and channel walls 128. Preferably, the setting means 124 is made of a precious metal material such as gold or platinum.

The base 126 includes three rows of cavities 132, each cavity 132 configured for accepting pavilions 14 of the anchor gemstones 120 and the touch gemstones 122. The cavities are sized so that the gemstone pavilions 14 can be held in the cavities 132 with the gemstone crowns 12 and girdles 16 sitting above the top of the base 126, with contoured wedges half way around each anchor gemstone 120. The cavities 132 can also include angled side walls 134 for further accommodating an angled gemstone pavilions 14.

The channel walls 126 are configured for holding the rows of anchor gemstones 120 in place in the jewelry apparatus 118. The channel walls 126 include grooves 136 that mate with the girdle 16 of each of the anchor gemstones 120.

As illustrated in FIG. 5, the girdles 16 of the touch gemstones 122 are set slightly below the girdles of the anchor gemstones 120. The row of touch gemstones 122 is placed in the center row of cavities 132, with the rows of anchor gemstones 120 placed on opposite sides of the row of touch gemstones 122. In this manner, two anchor gemstones 120 contact each touch gemstone 122, holding the touch gemstone 122 in place in the jewelry apparatus 118.

The center row of cavities 132 in the base 126 is sized to hold the girdles of touch gemstones 122 slightly lower than the girdles of anchor gemstones 120, and the rows of cavities 132 are positioned so that the girdles of anchor gemstones 120 overlap the girdles of touch gemstones 122. As illustrated in FIG. 5, the upper pavilion 14 of each anchor gemstone 120 contacts the crown 12 of each adjacent touch gemstone 122 to lock the row of touch gemstones 122 in place.

Because the rows of anchor gemstones 120 overlap the row of touch gemstones 122, the row of touch gemstones 122 is held in place with no metal from the setting means 124 visible between the rows of anchor gemstones 120 and the row of touch gemstones 122.

A method for setting rows of gemstones according to the present invention comprises forming a base 126 including rows of cavities 132 in a setting means 124 of a piece of jewelry, placing the row of touch gemstones 122 in the center row of cavities in the base 126 of the setting means 124, and placing the rows of anchor gemstones 120 in the outer rows of cavities 132 in the base 126 of the setting means 124 with the girdle 16 of each anchor gemstone 120 in the groove 136 in the side wall 128 of the setting means 124. The girdles of anchor gemstones 120 are positioned overlapping the girdles of touch gemstones 122 such that the pavilions 14 of the rows of anchor gemstones 120 contact the crowns 12 of the row of touch gemstones 122. The row of touch gemstones 122 is thereby held in place without using metal or prongs between the rows of anchor gemstones 120 and the row of touch gemstones 120.

It will be apparent to those skilled in the art that modifications may be made without departing from the spirit and scope of the invention. Accordingly, it is not intended that the invention be limited except as may be necessary in view of the appended claims.

What is claimed is:

1. A jewelry apparatus comprising:

first, second and third gemstones, each having a pavilion, a girdle and a crown;

first, second and third settings for receiving said first, second and third gemstones, respectively, in said jewelry apparatus wherein said third gemstone is between said first and second gemstones, said first and second settings overlapping parts of said crowns of said first and second gemstones but not any part of said crown of said third gemstone, said third gemstone held between said pavilions of said first and second gemstones, and said first and second settings comprise a wedge between said first and second gemstones for holding said first and second gemstones, wherein the gemstones are substantially the same size.

2. The jewelry apparatus of claim 1 wherein said first, second and third settings further comprise a base having first, second and third cavities of substantially the same size as said pavilions of said first, second and third gemstones, respectively, and wherein said pavilions of said first, second and third gemstones rest in said first, second and third cavities, respectively.

3. The jewelry apparatus of claim 2 wherein said first, second and third cavities are configured to hold said first, second and third gemstones with said third gemstone girdle below said first and second gemstone girdles.

4. The jewelry apparatus of claim 1 wherein said pavilions of said first and second gemstones contact said crown of said third gemstone.

5. The jewelry apparatus of claim 1 wherein said wedge includes a width, a top end and a bottom end, said width being thinner near said bottom than said top end.

6. The jewelry apparatus of claim 1 wherein said first and second settings are selected from the group consisting of channel walls, grooves and prongs.

7. The jewelry apparatus of claim 1 wherein said first and second settings further comprise channel walls configured to retain said first and second gemstones in said first and second settings, respectively.

* * * * *